US005509273A

United States Patent [19]

Lakowske et al.

[11] Patent Number: 5,509,273

[45] Date of Patent: Apr. 23, 1996

[54] GAS ACTUATED SLIDE VALVE IN A SCREW COMPRESSOR

[75] Inventors: Rodney L. Lakowske; Arthur L. Butterworth; Garry E. Andersen, all of La Crosse, Wis.

[73] Assignee: American Standard Inc., Piscataway, N.J.

[21] Appl. No.: 393,957

[22] Filed: Feb. 24, 1995

[51] Int. Cl.[6] ..... F25B 49/02; F04B 49/02; F04C 18/16; F04C 29/10

[52] U.S. Cl. ..... 62/228.5; 418/1; 418/201.2; 418/DIG. 1; 417/310; 417/440

[58] Field of Search ..... 418/1, 201.2, DIG. 1; 417/310, 440; 62/228.5

[56] References Cited

U.S. PATENT DOCUMENTS

| | | | |
|---|---|---|---|
| 4,025,244 | 5/1977 | Sato | 418/87 |
| 4,076,461 | 2/1978 | Moody, Jr. et al. | 417/310 |
| 4,342,199 | 8/1982 | Shaw et al. | 417/310 |
| 4,747,755 | 5/1988 | Ohtsuki et al. | 417/282 |

FOREIGN PATENT DOCUMENTS

| | | | |
|---|---|---|---|
| 60-164693 | 8/1985 | Japan | 418/201.2 |
| 3-15693 | 1/1991 | Japan | 418/DIG. 1 |

*Primary Examiner*—John J. Vrablik
*Attorney, Agent, or Firm*—William J. Beres; William O'Driscoll; Peter D. Ferguson

[57] ABSTRACT

The position of a slide valve in a screw compressor in a refrigeration system is controlled using a gaseous medium sourced from the higher pressure one of two or more sources of such fluid. Preferred sources are refrigerant gas in a closed compression pocket in the working chamber of the compressor and refrigerant gas in the discharge passage downstream of the compressor's discharge port. The multiple sources of such gas are connected to a solenoid valve which, when open, permits gas to act on the piston which controls the position of the slide valve. Due to a check valve arrangement, it is always the one of the sources of gas which is at higher pressure that acts on the slide valve actuating piston. The adverse affects of refrigerant gas out-gassing and gas bubble collapse associated with use of hydraulic fluid rather than a gaseous medium to modulate compressor capacity are avoided while advantageous use is made of compressor overcompression in the control of slide valve position.

34 Claims, 6 Drawing Sheets

GAS ACTUATED SLIDE VALVE IN A SCREW COMPRESSOR

BACKGROUND OF THE INVENTION

The present invention relates to the compression of gas in a rotary compressor. More particularly, the present invention relates to the control, by the use of a gaseous medium, of the position of a slide valve in a refrigeration screw compressor.

Compressors are used in refrigeration systems to raise the pressure of a refrigerant gas from an evaporator to a condenser pressure (more generically referred to as suction and discharge pressures respectively) which permits the ultimate use of the refrigerant to cool a desired medium. Many types of compressors, including rotary screw compressors, are commonly used in such systems. Rotary screw compressors employ male and female rotors mounted for rotation in a working chamber which is a volume shaped as a pair of parallel intersecting flat-ended cylinders closely toleranced to the exterior dimensions and shapes of the intermeshed screw rotors.

A screw compressor has low and high pressure ends which respectively define suction and discharge ports that open into the working chamber. Refrigerant gas at suction pressure enters the suction port from a suction area at the low pressure end of the compressor and is delivered to a chevron shaped compression pocket formed between the intermeshed rotors and the interior wall of the working chamber.

As the rotors rotate, the compression pocket is closed off from the suction port and gas compression occurs as the pocket's volume decreases. The compression pocket is circumferentially and axially displaced to the high pressure end of the compressor where it comes into communication with the discharge port.

Screw compressors most typically employ slide valve arrangements by which the capacity of the compressor is controlled over a continuous operating range. The valve portion of a slide valve assembly is disposed within and constitutes a part of the rotor housing. Certain surfaces of the valve portion of the slide valve assembly cooperate with the rotor housing to define the working chamber of the compressor.

Slide valves are axially moveable to expose a portion of the working chamber and the rotors therein to a location within a screw compressor, other than the suction port, which is at suction pressure. As a slide valve opens to greater and greater degrees, a larger portion of the working chamber and the screw rotors therein are exposed to suction pressure other than through the suction port. The portion of the rotors and working chamber so exposed is prevented from engaging in the compression process and the compressor's capacity is proportionately reduced. The positioning of the slide valve between the extremes of the full load and unload positions is relatively easily controlled as is, therefore, the capacity of the compressor and the system in which it is employed. Historically, slide valves have been positioned hydraulically using oil which has a multiplicity of other uses within the compressor.

In refrigeration applications, such other uses of oil in a screw compressor include bearing lubrication and the injection of oil into the gas undergoing compression in the working chamber of the compressor. Injected oil acts as a sealant between the meshing screw rotors and between the rotors and the interior surface of the working chamber. The injected oil also lubricates and prevents excess wear between the rotors. Finally, in some applications oil is injected into the working chamber to cool the refrigerant undergoing compression which, in turn, reduces thermal expansion in the compressor and allows for tighter rotor clearances at the outset.

Such oil is most typically sourced from an oil separator where discharge pressure is used to drive oil from an oil sump in the separator to compressor injection ports and bearing surfaces and to control the position of the slide valve. In each case, the pressure differential between the relatively higher pressure source of the oil (the oil separator) and a location within the compressor which is at a relatively lower pressure is taken advantage of to ultimately return the oil, after its use, to the oil separator.

In that regard, oil which has been used for its intended purpose in a screw compressor is vented or drained from the location of its use to a relatively lower pressure location within the compressor or in the system in which the compressor is employed. In the typical case, such oil is vented or drained to, or is used in the first instance, in a location which contains refrigerant gas at suction pressure or at some pressure which is intermediate compressor suction and discharge pressure.

Such oil mixes with and becomes entrained in the refrigerant gas in the location to which it is vented, drained or used and is delivered back to the oil separator, at discharge pressure, in the stream of compressed refrigerant gas discharged from the compressor. The oil is separated from the refrigerant gas in the separator and is deposited in the sump therein from which it is directed, most often using the discharge pressure which exists in the oil separator, back to the compressor locations identified above for further use. Even after the occurrence of the separation process, however, the oil in the sump of the oil separator will contain refrigerant gas bubbles and/or quantities of dissolved refrigerant. The separated oil may, in fact, contain from 10–20% refrigerant by weight depending upon the solubility properties of the particular oil and refrigerant used.

One difficulty and disadvantage in the use of such oil to hydraulically position the slide valve in a screw compressor relates to the fact that the oil used for that purpose will, as noted above, typically contain at least some dissolved refrigerant and/or bubbles of refrigerant gas. As a result of the use of such fluid to hydraulically position the piston by which the compressor slide valve is actuated, slide valve response can sometimes be inconsistent, erratic and/or slide valve position can drift as dissolved refrigerant entrained in the hydraulic fluid vaporizes (so-called "out gassing") or as entrained refrigerant gas bubbles collapse.

The out-gassing of refrigerant from the hydraulic fluid, which occurs when the pressure in the cylinder in which the slide valve actuating piston is housed is vented to cause unloading of the compressor, and the collapse of refrigerant gas bubbles entrained therein causes a volumetric change in the hydraulic fluid which affects the ability of that fluid to maintain slide valve position or properly position the slide valve in the first instance. Further, under certain conditions, such as where ambient temperatures at compressor startup cause system pressures downstream of the compressor discharge port to be lower than the pressure of gas undergoing compression in the compressor's working chamber, the pressure in the oil separator may be insufficient to cause the slide valve to move or be sufficiently responsive for safe and reliable compressor operation.

Still another disadvantage in the use of oil to hydraulically position the slide valve in a refrigeration screw compressor relates to the fact that the quantity of refrigerant gas bubbles and dissolved liquid refrigerant contained therein varies with time and with the characteristics and composition of the particular batch of lubricant delivered to the slide valve actuating cylinder. In that regard, slide valves are most typically controlled through a supposition that the opening of a load or unload solenoid valve for a predetermined period of time results in slide valve movement that is repeatable and consistent with that period of time. That supposition is, in turn, predicated on the supposition that the characteristics and composition of the oil directed to or vented from the slide valve actuating cylinder during such a period of time is consistent.

However, because of the inconsistency in the characteristics and composition of the oil supplied to and vented from the slide valve actuation cylinder with respect to the nature and amount of refrigerant contained therein, slide valve movement during any particular time period is not precisely repeatable or predictable. This lack of consistency and repeatability, from the control standpoint, is disadvantageous and reduces the efficiency of the compressor.

The need therefore exists for an arrangement by which to control the position of a slide valve in a refrigeration screw compressor which eliminates the disadvantages associated with the use of hydraulic fluid in which dissolved refrigerant and/or refrigerant gas bubbles exist and which permits the more precise and consistent control of slide valve position under all compressor and system operating conditions including those during which downstream system pressure is less than the pressure which is reached in the compression pockets internal of the compressor's working chamber.

SUMMARY OF THE INVENTION

It is an object of the present invention to control the position of a slide valve in a screw compressor using a gas rather than a hydraulic fluid.

It is a still further object of the present invention to employ refrigerant gas rather than hydraulic fluid in the positioning of a slide valve in a refrigeration screw compressor to ensure that the quantity of the actuating fluid used to position the slide valve delivered to or vented from the slide valve actuating cylinder during a predetermined period of time is consistent and repeatable.

It is a further object of the present invention to eliminate the reduced responsiveness associated with the use of system lubricant, in which liquid refrigerant and refrigerant gas bubbles exist, to hydraulically position a slide valve in a screw compressor.

It is a further object of the present invention to provide an arrangement by which responsive and precise control of the position of a slide valve in a screw compressor is achieved when system operating conditions result in the creation of pressures internal of the compressor which are greater than system operating pressures downstream thereof.

In that regard, it is a particular object of the present invention to provide slide valve control using the gas pressure available in a compression pocket in the working chamber of a screw compressor under the circumstance where gas pressure in the pocket exceeds gas pressure downstream of the working chamber.

lit is a still further object of the present invention to control the position of a slide valve in a screw compressor by the use of gas sourced from the one of the more than one available sources which is at the higher pressure.

These and other objects of the present invention, which will be appreciated from the following Description of the Preferred Embodiment and the attached Drawing Figures, are achieved in a screw compressor having a slide valve the position of which is controlled through the use of a gaseous medium. The medium is preferably a fluid comprised of the gas which undergoes compression within the compressor and is sourced from either the system in which the compressor and the gas is employed or from a location in the working chamber of the compressor. The compressor slide valve is connected by a rod to a piston slideably disposed in an actuating cylinder.

Load and unload solenoid valves operate and are controlled to admit gaseous fluid to or vent fluid from the cylinder so as to position the slide valve such that the compressor produces compressed refrigerant gas at a rate in accordance with the demand on the system in which the compressor is employed. The load solenoid valve is in flow communication with two different sources of refrigerant gas through a common conduit. By opening the load solenoid valve, gas is admitted to the cylinder in which the slide valve actuating piston is disposed causing, in turn, the slide valve to move in a direction which further loads the compressor.

Opening of the unload solenoid valve vents the actuation cylinder to a relatively lower pressure location which, in turn, causes the slide valve to move in a direction which reduces the load on the compressor. A check valve arrangement is disposed between the two or more sources of gas and the load solenoid valve so that the gas supplied to the load solenoid valve to activate the slide piston is automatically sourced from the one of the two or more sources where pressure is highest.

A primary advantage of the present invention is its ability to position the slide valve assembly under so-called "hot start" conditions. Hot start conditions exist when a refrigeration system must be started in ambient conditions which cause initial condenser temperatures to be relatively cool, either approaching or below evaporator temperatures, and initial evaporator temperatures to be relatively hot, either approaching or above condenser temperatures. In prior art systems, where hydraulic fluid from the system oil separator is used to position the compressor slide valve, hot start conditions many times prevented the buildup of sufficient pressure within the oil separator to drive oil out of the separator with sufficient force to position the slide valve out of its unload position quickly enough. As a result, the refrigeration system might repetitively shut down prior to achieving steady state operation due to insufficient oil pressure, traceable back to temperature conditions within the system.

Another significant advantage of the present invention is its ability to control the position a slide valve in a more consistent and repeatable manner thereby enhancing the efficiency of the compressor under varying operating conditions. This is because the amount and composition of the refrigerant gas delivered to the slide valve actuating cylinder during a predetermined period of time is more quantifiable and consistent than is the case with a hydraulic fluid that contains a variable and unpredictable amount of refrigerant, either in gas bubble or dissolved form in operation.

The present invention overcomes this adversity by providing a gaseous fluid, in the form of the refrigerant gas which is the working fluid of the refrigeration system in which the compressor is employed, from the one of two or more sources of such gas which is at higher pressure and which is immediately available on compressor startup, to position a screw compressor slide valve. Under hot start conditions, the pressure which develops in a compression pocket in the compressor's working chamber immediately prior to its opening to the discharge port is higher than the pressure downstream thereof. In that sense, the compressor is "overcompressing" the refrigerant gas under such conditions to a pressure which decreases as soon as the compression pocket opens to the discharge port.

In the present invention, such overcompression is taken advantage of, under hot start conditions, to immediately provide an actuating fluid of sufficient pressure by which to effect the movement of the slide valve to load the compressor. At such time as system operating conditions normalize and/or steady state operation is achieved, gas from downstream of the compressor discharge port will automatically take over the function of actuating the slide valve to the extent that overcompression ceases to occur within the compressor.

DESCRIPTION OF THE DRAWING FIGURES

DESCRIPTION OF THE PREFERRED EMBODIMENT

Figure 1:
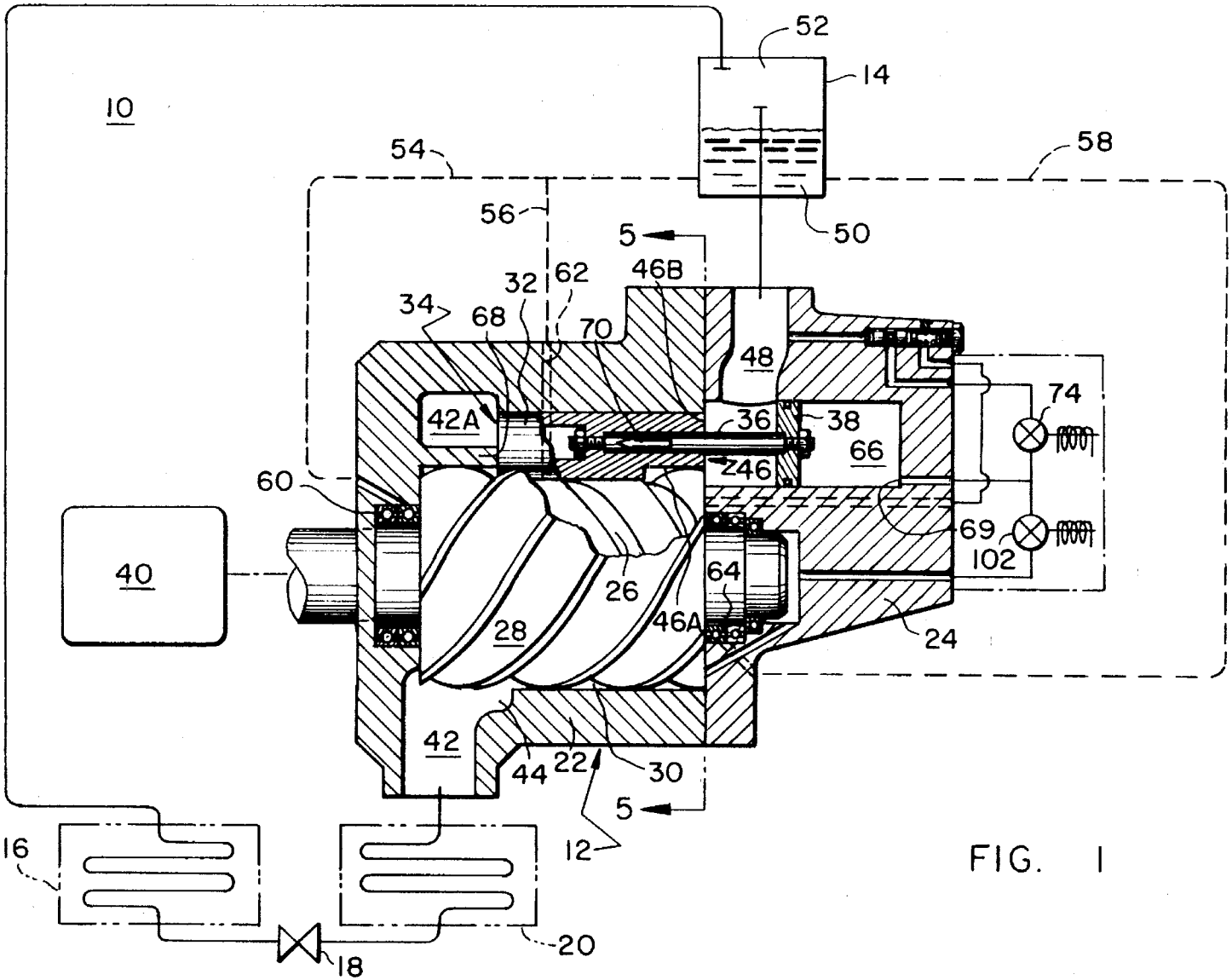
FIG. 1 is a cross-section/schematic view of a screw compressor slide valve position controlling arrangement of the present invention.

Referring first to FIG. 1, refrigeration system 10 is comprised of a compressor assembly 12, an oil separator 14, a condenser 16, an expansion device 18 and an evaporator 20 all of which are serially connected for the flow of refrigerant therethrough. Compressor assembly 12 includes a rotor housing 22 and a bearing housing 24 which together are referred to as the compressor housing. A male rotor 26 and a female rotor 28 are disposed within working chamber 30 of the compressor which is cooperatively defined by rotor housing 22, bearing housing 24 and the valve portion 32 of slide valve assembly 34. Slide valve assembly 34, which in the preferred embodiment is a so-called capacity control slide valve assembly, is additionally comprised of connecting rod 36 and actuating piston 38. One of male rotor 26 or female rotor 28 is driven by a prime mover such as electric motor 40.

Refrigerant gas at suction pressure is directed from evaporator 20 to communicating suction areas 42 and 42A at the low pressure end of compressor 12. Gas at suction pressure flows into suction port 44, in this case underneath the rotors, and enters a compression pocket defined between rotors 26 and 28 and the interior surface of working chamber 30. By the counter rotation and meshing of the rotors, the compression pocket is reduced in size and is circumferentially displaced to the high pressure end of the compressor where the now compressed gas flows out of the working chamber through discharge port 46 and into discharge passage 48.

With reference to discharge port 46 and to discharge ports in screw compressors in the general sense, discharge port 46 is comprised of two portions. The first portion being radial portion 46A which is formed on the discharge end of valve portion 32 of the slide valve assembly and the second portion being axial portion 46B which is formed in the discharge face of the bearing housing. The geometry and interaction of these two discharge port portions with the slide portion of the slide valve assembly controls compressor capacity and efficiency.

Both portions of discharge port 46 affect compressor capacity until the slide valve assembly 34 unloads far enough such that the radial discharge port is no longer located over the screw rotors. In that condition it is only the axial port which is active, with the slide, in determining compressor capacity. Therefore, during compressor startup, when slide valve assembly 34 is in the full unload position, the axial portion of discharge port 46 will be the only active portion of the discharge port.

Discharge gas, which has oil entrained in it, is directed out of the discharge port and discharge passage to oil separator 14 where the oil is separated from the compressed refrigerant gas and settles into sump 50. The discharge pressure in the gas portion 52 of oil separator 14 acts on the oil in sump 50 to drive such oil through supply lines 54, 56 and 58 to various locations within compressor 12. In that regard, oil supply line 54 provides oil to lubricate bearing 60 while supply line 56 directs oil to injection passage 62 in the rotor housing. Supply line 58 directs oil to bearing 64 at the high pressure end of the compressor.

Slide valve actuating piston 38 is disposed in actuating cylinder 66 within bearing housing 24. As will be appreciated, the position of the slide valve actuating piston within cylinder 66 is determinative of the position of valve portion 32 of the slide valve assembly within rotor housing 22. Because of the relative surface areas of the faces of valve portion 32 and piston 38 which are exposed to discharge pressure in passage 48 and because the end face of valve portion 32 which abuts slide stop 68 of the compressor is exposed to suction pressure while the face of piston 38 facing into cylinder 66 is selectively acted upon by fluid at discharge pressure or higher, the admission of gaseous fluid to cylinder 66 through aperture 69 will cause slide valve movement in the direction of arrow 70 to load the compressor.

In FIG. 1, slide valve assembly 34 is illustrated in the full load position with valve portion 32 in abutment with slide stop 68. In that position, working chamber 30 and the male and female screw rotors are exposed to the suction area of the compressor through suction port 44.

When slide valve assembly 34 is positioned such that valve portion 32 is moved away from slide stop 68, working chamber 30 and an upper portion of male rotor 26 and female rotor 28 are exposed to suction pressure portion 42A in the rotor housing in addition to their exposure to suction area 42 through suction port 44. The upper portions of male rotor 26 and female rotor 28 so exposed are rendered incapable of participating in the definition of a closed compression pocket or in the compression process and the compressor's capacity is accordingly reduced.

Figure 2:
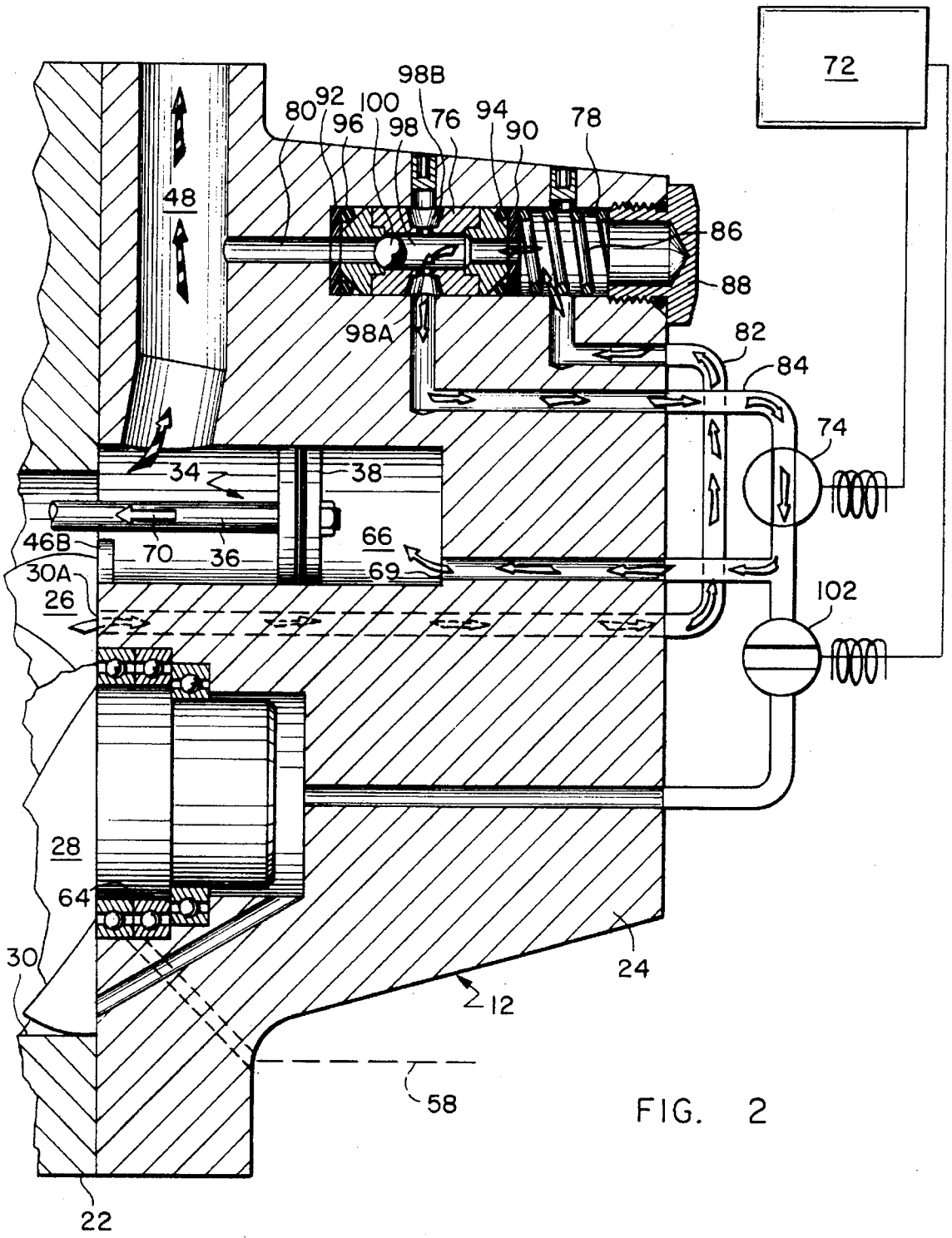
FIG. 2 is an enlarged view of the bearing housing portion of the compressor of FIG. 1 illustrating an open load solenoid and the sourcing of slide valve actuating fluid from the working chamber of the compressor.
Figure 5:
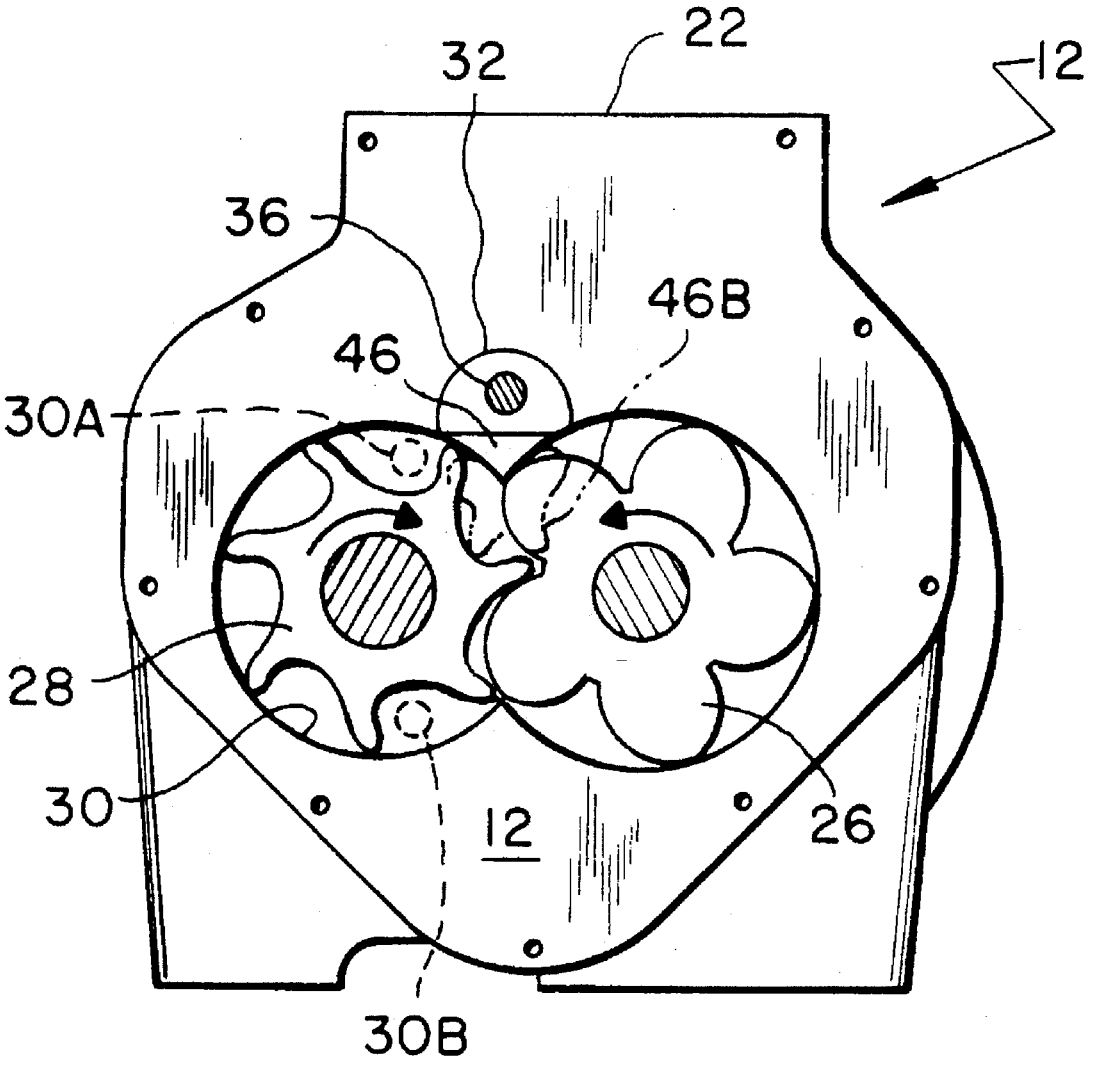
FIG. 5 is taken along line 5—5 of FIG. 1.

Referring additionally now to FIGS. 2 and 5, the preferred embodiment for the control of slide valve actuating piston 38 will be described in the context of the "overcompression" circumstance where the pressure in a closed compression pocket within the working chamber of the compressor is higher than the pressure in discharge passage 48. That circumstance occurs when system pressures downstream of the discharge port of the compressor are relatively low as a result of the ambient conditions in which refrigeration system 10 is operating or at compressor/system startup.

It is to be noted that the slide valve will be positioned to the full unload position when the compressor shuts down so that the current drawn by the compressor motor at startup remains within limits. In the overcompression circumstance of FIG. 2 and where the load on the refrigeration system in which compressor 12 is employed is increasing, such as at startup, a signal is sent by controller 72 to position load solenoid valve 74 to permit flow therethrough. In the open position, pneumatic fluid in the form of refrigerant gas is permitted to flow through the load solenoid and into actuating cylinder 66 so as to permit such fluid to act on slide valve actuating piston 38 and cause its movement in the direction of arrow 70.

The source of gas in the overcompression circumstance is a closed compression pocket internal of working chamber 30 of compressor 12. Such chamber is placed in flow communication with load solenoid valve 74 through shuttle check valve assembly 76 which is disposed in bore 78 in rotor housing 24. Bore 78 is, however, also capable of being placed in flow communication with discharge passage 48 through passage 80 as will subsequently be described.

Also in flow communication with bore 78 are passages 82 and 84. Passage 84 communicates between bore 78 and load solenoid valve 74. Passage 82 communicates through opening 30A between a closed compression pocket in working chamber 30 and bore 78. Opening 30A is located so as to communicate gas out of the closed compression pocket, on either the male or female rotor side, just prior to the opening of that pocket to the discharge port when the average pocket pressure is at its highest.

Shuttle check valve assembly 76 is of a commercially available type and is retained in place within bore 78 by positioning spring 86 and closure nut 88. Washers 90 and 92 act as seating surfaces for spring 86 and valve 76 respectively while O-rings 94 and 96 provide a fluid tight seal between valve assembly 76 and the inner surface of bore 78. Valve assembly 76 itself defines an axially running passage 98 in which ball 100 is rollably disposed. Passage 98 is in flow communication with passage 84 through ports 98A which communicate with peripheral groove 98B defined by valve assembly 76.

When the pressure of the gas in working chamber 30 at the location of opening 30A is higher than the pressure of the gas downstream of the discharge port 46 in discharge passage 48, as is illustrated in FIG. 2, the higher pressure in the compression pocket is communicated through opening 30A and passage 82 into bore 78 and then into passage 98 of the valve assembly 76. That pressure acts on ball 100 and against the pressure in discharge passage 48, as communicated through passage 80, to position ball 100 against a seat within valve assembly 76 as is illustrated.

It is to be noted that port 30A can open into either the male or female rotor side of the working chamber and that it is positioned so as to be in communication with a compression pocket immediately prior to the opening of that compression pocket to the discharge port. It is also to be noted that port 30A could open radially into such pocket through the use of radial passages (not shown) drilled into the rotor housing and/or slide portion of the slide valve. It is further to be noted that rather than communicate with discharge passage 48, passage 80 could run from bore 78 directly to oil separator 14 or to the conduit connecting discharge passage 48 of the compressor assembly to the oil separator with the same results being achieved.

When ball 100 is seated in valve assembly 76 as illustrated in FIG. 2, passage 80 is closed off from passage 84 and passage 84 is opened to the flow of gas from working chamber 30. Such gas is directed from load solenoid valve 74 into actuating cylinder 66 so as to further load the compressor by moving actuating piston 38 and the slide valve assembly in the direction of arrow 70.

At such time as the slide valve assembly is positioned in the direction of arrow 70 to the extent that compressor 12 is loaded in accordance with the demands on it, controller 72 closes load solenoid valve 74 thereby isolating cylinder 66 from passage 84 and from both of its sources of pneumatic actuating fluid. The gas trapped in cylinder 66 by the closure of load solenoid valve 74 maintains the position of piston 38 and slide valve assembly 34 constant until load solenoid valve 74 is next opened or until unload solenoid valve 102 is opened as will further be described.

Figure 3:
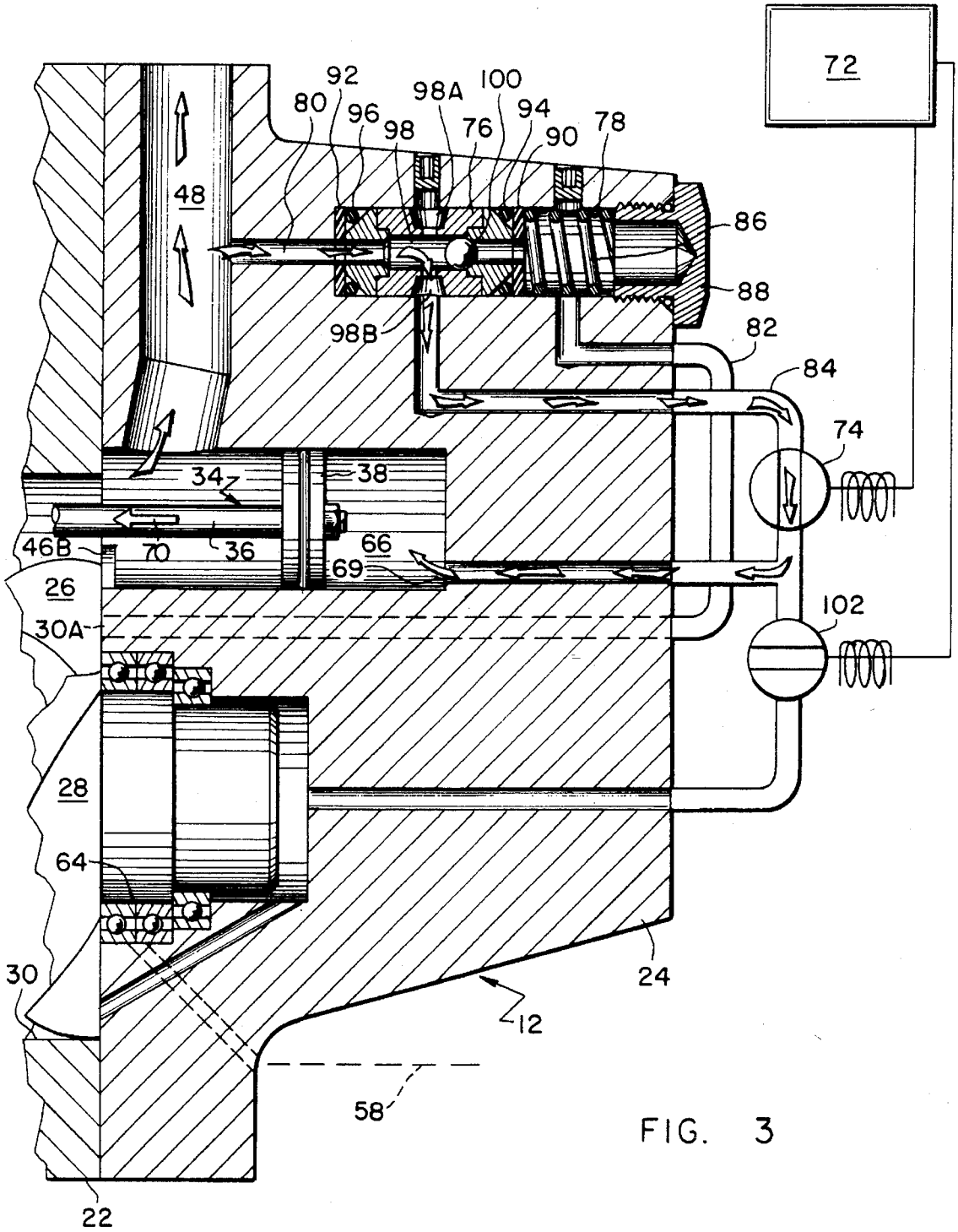
FIG. 3 is an enlarged view of the rotor housing portion of the compressor of FIG. 1 showing an open load solenoid and the sourcing of slide valve piston actuating fluid from the discharge passage of the compressor.

Referring now to FIG. 3, which is representative of the more typical steady state operating condition of the compressor, the positioning of actuating piston 38 in the direction of arrow 70 to further load compressor 12 by the use of pneumatic fluid sourced out of discharge passage 48 will be described. This circumstance will occur at such time as the conditions under which refrigeration system 10 operates are such that operating pressures downstream of discharge port 46 are greater than those developed in working chamber 30 at the location of opening 30A into passage 82.

Under that circumstance, the relatively higher pressure communicated from discharge passage 48 through passage 80 to valve assembly 76 acts on ball 100 to position it against the relatively lower pressure in passage 82 so as to close off passage 82 from communication with passage 84. Discharge passage 48 is thereby placed in flow communication with passage 84 and, upon the opening of the load solenoid, with slide valve actuation cylinder 66 to provide the impetus by which actuating piston 38 of slide valve assembly 34 is caused to further load the compressor.

It will be appreciated that the position of ball 100 within valve assembly 76 and the source of gaseous actuating fluid by which compressor 12 is further loaded is predicated on which of the sources of such gas, discharge passage 48 or working chamber 30, is at the higher pressure. That source will automatically be the source of pneumatic slide valve actuating fluid which is immediately available upon the opening of the load solenoid valve.

Figure 4:
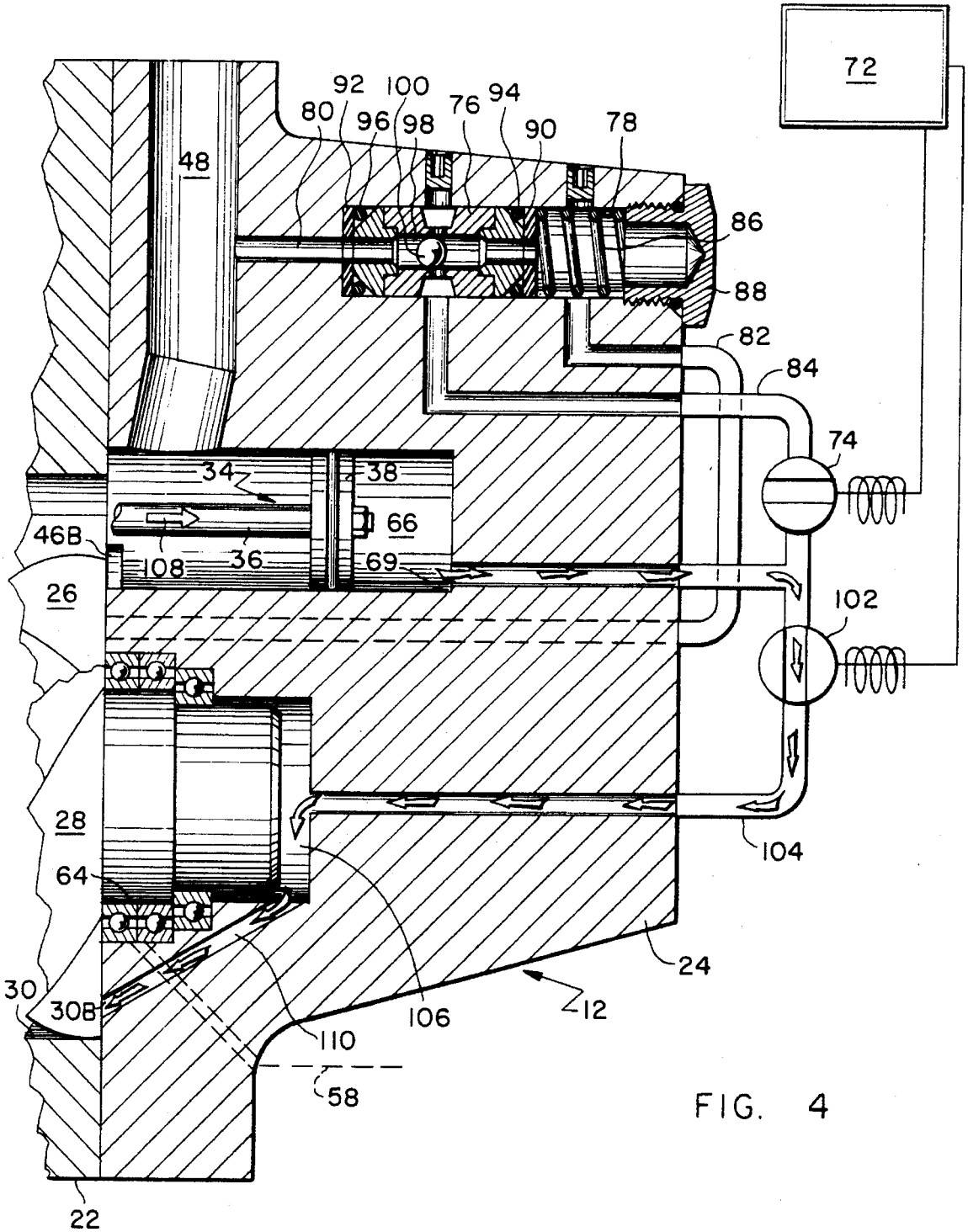
FIG. 4 is an enlarged view of the rotor housing of the compressor of FIG. 1 showing an open unload solenoid and the venting of slide valve actuating fluid to a relatively lower pressure location within the compressor.

Referring now to FIGS. 4 and 5, the unloading of compressor 12 is illustrated. Under circumstances calling for reduced compressor capacity, load solenoid valve 74 is closed and unload solenoid valve 102 is opened by controller 72. The positioning of unload solenoid valve 102 in the open position places cylinder 66 in flow communication through passage 104 with a location within compressor 12, such as bearing cavity 106, which is preferably at or near suction pressure.

The opening of unload solenoid valve 102 therefore vents cylinder 66 and the relatively much higher pressure fluid contained within it to a relatively much lower pressure location within the compressor assembly causing slide valve assembly 34 to move in the direction of arrow 108. In that regard, the surface areas of the slide valve assembly are designed such that the net effect of the gas forces acting on them, under the circumstance where cylinder 66 is vented, is to urge the slide valve assembly in the direction of arrow 108. The closure of unload solenoid valve 102 stops the movement of slide valve assembly 34 in that direction and maintains the position of the slide valve and the load on the compressor constant until the next opening of either the load or unload solenoid valves.

Bearing cavity 106 preferably drains or vents, such as through passage 110 and opening 30B, to a so-called "idling" pocket within the working chamber of the compressor which is at or near suction pressure. Such a pocket is a closed pocket, that is, a pocket closed off from suction, in which the compression process has not yet begun to occur.

Figure 6:
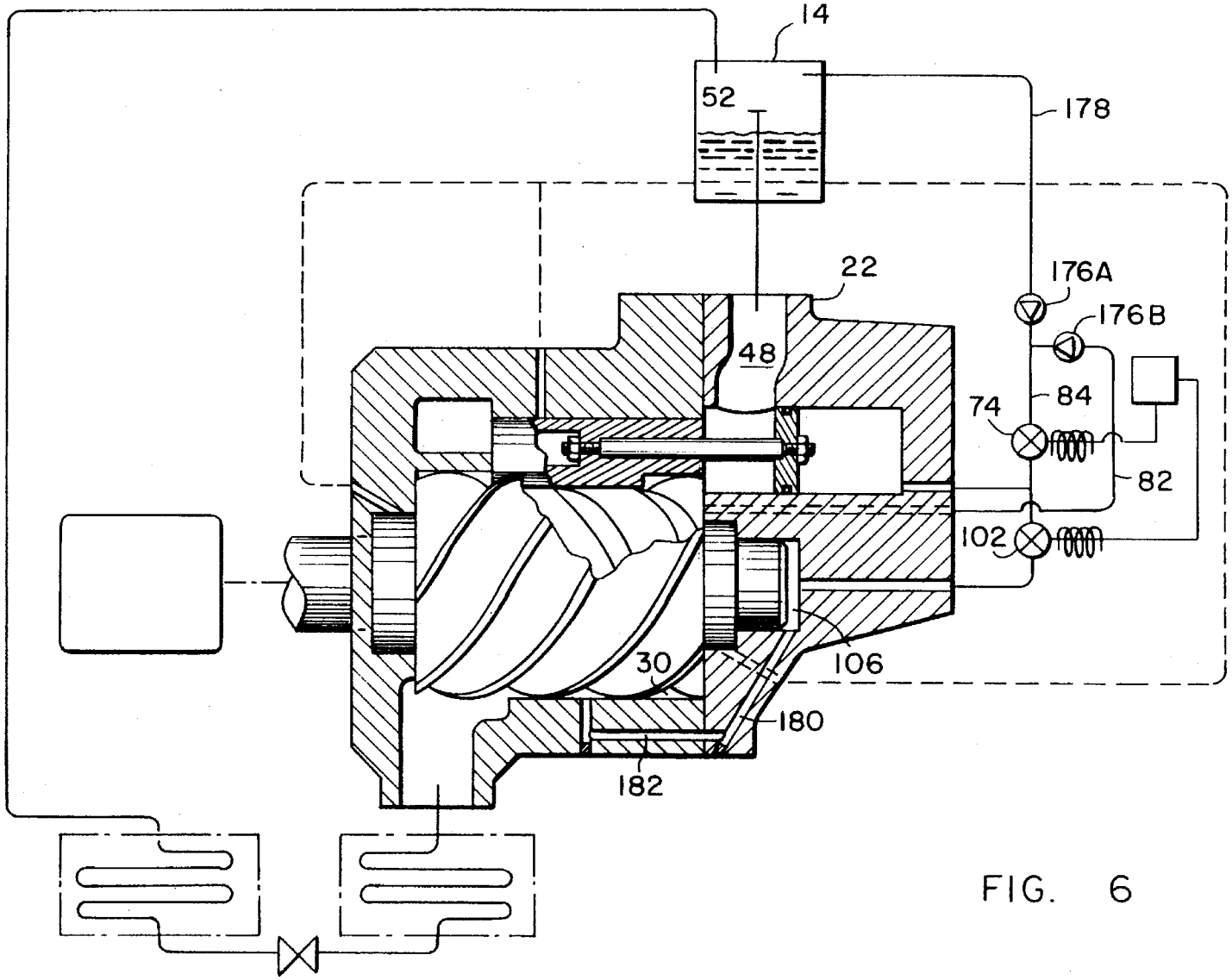
FIG. 6 is an alternative to the embodiment of FIG. 1 schematically illustrating the use of dual check valves rather than a unitary check valve assembly and the sourcing of actuating fluid from the system oil separator.

Referring now to the alternative embodiment of FIG. 6, a slightly modified embodiment of the present invention is illustrated. In the embodiment of FIG. 6, shuttle check valve assembly 76 is replaced by individual check valves 176A and 176B which are each in flow communication with load solenoid valve 74 through conduit 84. Conduit 82 connects to check valve 176B. Further, rather than one source of slide valve actuating fluid being gas flowing through passage 48 in the rotor housing, check valve 176A is in flow communication through line 178 with discharge gas portion 52 of oil separator 14. It will be appreciated that like valve assembly 76, individual check valves 176A and 176B could be housed within rotor housing 22 or, as schematically illustrated, can be disposed in piping external of the compressor.

The embodiment of FIG. 6 is also somewhat different in that bearing cavity 106, rather than venting axially into an idler pocket in the working chamber 30 through opening 30B the end face of the bearing housing, as described with respect to FIGS. 1–5, is vented through passage 180 in the bearing housing which aligns and communicates with passage 182 of the rotor housing. Passage 182, like opening 30B in the FIGS. 1–5 embodiment, opens into an idler pocket within working chamber 30. The embodiment of FIG. 6 otherwise functions in the same manner as the embodiment of FIGS. 1–5 in every respect.

It will be appreciated that at some time subsequent to system startup and once the system has continued in operation for a period of time, the pneumatic fluid used to actuate the slide valve assembly will come to contain more oil than it will when the system initially starts up for the reason that it is only after system startup and only after sufficient pressure comes to develop within the oil separator that oil is driven to the compressor for bearing lubrication and oil injection purposes. Oil will not, however, be found in any appreciable quantity in the compressor's working chamber at system startup for the reason that the working chamber is isolated from the oil separator by apparatus (not shown) when the compressor shuts down in order to ensure that the oil supply in the oil separator does not migrate therefrom and into the compressor's working chamber. In that regard, it is important to ensure that the sufficient oil is maintained in the sump of the oil separator to ensure that an adequate supply of oil is immediately available for lubrication purposes when the compressor next starts up.

Gas actuation of the slide valve assembly at system startup is far more quickly and reliably achieved in the compressor of the present invention in a manner which overcomes the adverse affects of both refrigerant gas outgassing and gas bubble collapse which are found in hydraulic slide valve actuating arrangements. The present invention also makes advantageous use of refrigerant gas overcompression at a time when slide valve responsiveness is critical to the safe, reliable and continued operation of the compressor.

It is to be noted that by locating aperture 69 of cylinder 66 at the bottom or in a lower region thereof, the buildup of any oil or liquid which may make its way into cylinder 66 is avoided since any such liquid will be flushed from cylinder 66 with each unload command. Pure gas actuation of piston 38 is thereby achieved, without influence of liquid to any significant degree.

It has been noted that by use of refrigerant gas from within the system in which the compressor is employed to gas actuate rather than hydraulically actuate a compressor slide valve and by the use of overcompression which occurs within the compressor under certain operating conditions, successful and immediate actuation of a screw compressor capacity control slide valve under so-called hot start conditions is achievable by the compressor of the present invention. Hot start conditions occur when the temperature differential between the system condenser and the system evaporator at compressor startup is such that it is difficult to build sufficient pressure in the oil separator to ensure an adequately pressurized supply of oil to the compressor in a timely manner. In that regard, a successful "hot start" is considered to be achieved when a predetermined differential suction to discharge pressure is achieved which is sufficient to drive oil to the compressor prior to the time a differential pressure safety control would otherwise shut down the compressor.

The compressor of the present invention has been successful in achieving "hot starts" in a laboratory setting where the condenser temperature was 32° F. below the evaporator temperature at startup. By way of contrast, prior hydraulically actuated slide valve actuation schemes often required that condenser temperatures be at least 10° F. above evaporator temperature to assure a successful start, that is, a start in which pressure develops quickly enough in the oil separator to assure an adequately pressurized supply of oil to the compressor in a timely manner.

It is also to be noted that an additional advantage of the gas actuation arrangement of the present invention is that its implementation can be accomplished through the use of flow passages formed only in the bearing housing and passages which do not need to be aligned with or communicate with passages in the rotor housing of the compressor. It is still further to be noted that the present invention is equally applicable to the control of slide valves and screw compressors of types other than capacity control slide valves. For instance, the slide valve actuation arrangement of the present invention is applicable to the control of so-called volume ratio control slide valves as well as to the control of multiple slide valves in a screw compressor whatever their purpose, number or type might be.

As has also been noted, the compressor of the present invention is more predictably and accurately controlled due to the consistency of refrigerant gas, when employed as an actuating fluid, as compared to the relatively inconsistent makeup, in terms of entrained gas bubbles and/or dissolved refrigerant, of the hydraulic fluid most typically used in such applications. As a result of the consistency of the gaseous medium used to control the position of the slide valve assembly in the present invention, much more precise and repeatable control of slide valve position is achieved and compressor efficiency is enhanced.

While the present invention has been described in terms of both a preferred and alternative embodiment, it will be appreciated that still other embodiments, falling within the scope of the invention as claimed, will be apparent to those skilled in the art and are contemplated hereby.

What is claimed is:

1. A refrigeration screw compressor, having a suction and discharge port, comprising:

a housing, said housing defining a working chamber in flow communication with said suction and said discharge ports of said compressor;

a male rotor disposed in said working chamber;

a female rotor disposed in said working chamber in meshing engagement with said male rotor, rotation of said male and said female rotors operating to compress a gaseous working fluid within said working chamber from a suction to a discharge pressure;

a slide valve, said slide valve having an actuating piston;

a first conduit for selectively communicating refrigerant gas from said working chamber to said actuating piston at a pressure sufficient to move said slide valve in a direction which loads said compressor; and a second conduit for selectively venting refrigerant gas communicated to said actuating piston to a location in said compressor where the pressure is less than discharge pressure so as to move said slide valve in a direction which unloads said compressor.

2. The refrigeration screw compressor according to claim 1 wherein the refrigerant gas communicated from said working chamber through said first conduit is communicated from a closed compression pocket defined in said working chamber by said male and said female rotors.

3. The refrigeration screw compressor according to claim 2 further comprising a second source for refrigerant gas, other than said compression pocket, said slide valve being moved by refrigerant gas sourced from the one of said second source of refrigerant gas or said closed compression pocket which is at higher pressure.

4. The refrigeration screw compressor according to claim 3 wherein said second source of refrigerant gas is located downstream of said discharge port.

5. A refrigeration screw compressor, having a suction and discharge port, comprising:

a housing, said housing defining a working chamber in flow communication with said suction and said discharge ports of said compressor;

a male rotor disposed in said working chamber;

a female rotor disposed in said working chamber in meshing engagement with said male rotor, rotation of said male and said female rotors operating to compress a gaseous working fluid within said working chamber from a suction to a discharge pressure;

a capacity control slide valve, said slide valve having an actuating piston;

a first conduit which communicates refrigerant gas from one of a first and a second source of refrigerant gas, the source from which said refrigerant gas is communicated being at a pressure sufficient to move said slide valve in a direction which loads said compressor; and a second conduit for selectively venting refrigerant gas communicated to said actuating piston to a location in said compressor where the pressure is less than discharge pressure so as to move said slide valve in a direction which unloads said compressor.

6. The compressor according to claim 5 wherein the pressure of at least one of said first and second sources of refrigerant gas equals or exceeds discharge pressure when said compressor is in operation and wherein said first conduit communicates refrigerant gas from the one of said first and said second sources of refrigerant gas which is at higher pressure.

7. The compressor according to claim 6 wherein said first source of refrigerant gas is upstream of said discharge port and said second source of refrigerant gas is downstream of said discharge port.

8. The compressor according to claim 7 further comprising valve means, responsive to the respective pressures of said first and said second sources of refrigerant gas, for opening said first conduit to said higher pressure source of refrigerant gas and closing said first conduit off from the other source of refrigerant gas.

9. The compressor according to claim 8 wherein said valve means is automatically operative, in response to the circumstance where the pressure in said other source of refrigerant gas comes to exceed the pressure in said higher pressure source of refrigerant gas, to open said first conduit to said other source of refrigerant gas and to close said first conduit off from said higher pressure source of refrigerant gas.

10. The compressor according to claim 9 wherein said valve means comprises a valve assembly disposed in said first conduit and further comprising first and second solenoid valves, said first solenoid valve being disposed in said first conduit such that when said first solenoid valve is open, the flow of refrigerant gas through said first conduit occurs, said second solenoid being disposed in said second conduit such that when said solenoid is open, the venting of refrigerant gas through said second conduit occurs.

11. The compressor according to claim 7 wherein said first source of refrigerant gas is a closed compression pocket defined in said working chamber by said male and said female rotors.

12. The compressor according to claim 11 wherein said location to which refrigerant gas communicated to said actuating piston is vented is a closed compression pocket defined in said working chamber in which the compression of the refrigerant gas contained therein has not yet commenced.

13. The compressor according to claim 12 wherein said valve means comprises a valve assembly disposed in said first conduit and further comprising first and second solenoid valves, said first solenoid valve being disposed in said first conduit such that when said first solenoid valve is open, the flow of refrigerant gas through said first conduit occurs, said second solenoid being disposed in said second conduit such that when said solenoid is open, the venting of refrigerant gas through said second conduit occurs.

14. The compressor according to claim 13 wherein said first and said second conduits are passages defined internal of said housing.

15. The compressor according to claim 14 wherein said housing is comprised of a rotor housing and a bearing housing, said first and said second conduits being passages defined in said bearing housing.

16. A refrigeration system comprising:

an oil separator;

a condenser;

a metering valve;

an evaporator; and a screw compressor, said screw compressor compressing, in operation, a gaseous working fluid from a suction to a discharge pressure in a working chamber which is in flow communication with a suction and a discharge port, said compressor having a slide valve actuated by gaseous working fluid sourced from said working chamber when the pressure of refrigerant gas in said working chamber exceeds the pressure of working fluid downstream of said discharge port, but in or upstream of said oil separator, whenever said compressor is in operation.

17. The refrigeration system according to claim 16 wherein the refrigerant gas communicated from said working chamber is communicated from a closed compression pocket defined in said working chamber by said male and said female rotors.

18. The refrigeration system according to claim 17 further comprising a second source of gaseous working fluid, said slide valve being actuated by gaseous working fluid sourced from the one of said second source or said closed compression pocket in said working chamber which is at higher pressure.

19. The refrigeration system according to claim 18 wherein said second source of gaseous working fluid is located downstream of said discharge port.

20. A refrigeration system comprising:

an oil separator;

a condenser;

a metering valve;

an evaporator; and a screw compressor, said screw compressor compressing, in operation, a gaseous working fluid from a suction to a discharge pressure in a working chamber which is flow communication with a suction and a discharge port, said compressor having a slide valve actuated by gaseous working fluid which is selectively sourced from the one of at least two locations within said refrigeration system which is at higher pressure.

21. The refrigeration system according to claim 20 wherein both of said two locations are internal of said compressor.

22. The refrigeration system according to claim 20 wherein one of said locations is said working chamber and the other of said locations is said oil separator.

23. The refrigeration system according to claim 20 further comprising a first conduit, said first conduit selectively communicating between said at least two locations within said refrigeration system and said slide valve, and second conduit, said second conduit selectively communicating between said slide valve and a location in said working chamber of said compressor where the pressure of said gaseous working fluid is less than discharge pressure.

24. The refrigeration system according to claim 23 wherein one of said at least two locations from which gaseous working fluid is selectively sourced is upstream of said discharge port and said second location from which gaseous working fluid is selectively sourced is downstream of said discharge port.

25. The refrigeration system according to claim 24 further comprising valve means, automatically responsive to the respective pressures of said first and said second locations from which gaseous working fluid is sourced, for opening said first conduit means to the higher pressure one of said first and said second locations and for closing said first conduit means off from the other of said first and said second locations.

26. The compressor according to claim 25 wherein said valve means comprises a valve assembly disposed in said first conduit and further comprising first and second solenoid valves, said first solenoid valve being disposed in said first conduit such that when said first solenoid valve is open, the flow of gaseous working fluid through said first conduit occurs, said second solenoid being disposed in said second conduit such that when said solenoid is open, the venting of gaseous working fluid through said second conduit occurs.

27. A method of controlling the position of a slide valve in a refrigeration screw compressor which compresses a gaseous working medium from a suction to a discharge pressure in a working chamber having a suction and a discharge port, comprising the steps of:

supplying said gaseous working fluid to said compressor at a suction pressure;

compressing said gaseous working fluid in the working chamber of said compressor;

discharging said gaseous working fluid from said working chamber of said compressor through said discharge port; and controlling the position of the slide valve, so as to load said compressor, using said gaseous working fluid, said gaseous working fluid being sourced from the working chamber of said compressor.

28. The method according to claim 27 wherein said gaseous working fluid sourced from the working chamber of said compressor used for controlling the position of the slide valve is sourced from a closed compression pocket defined in said working chamber.

29. The method according to claim 28 further comprising a second source of gaseous working fluid for controlling the position of said slide valve, said slide valve being positioned by the one of said second source and said closed compression pocket which is at higher pressure.

30. The method according to claim 29 wherein said second source of gaseous working fluid is located downstream of said discharge port.

31. A method of controlling the position of a slide valve in a refrigeration screw compressor which compresses a gaseous working medium from a suction to a discharge pressure in a working chamber having a suction and a discharge port, comprising the steps of:

supplying said gaseous working fluid to said compressor at a suction pressure;

compressing said gaseous working fluid in the working chamber of said compressor;

discharging said gaseous working fluid from said working chamber of said compressor through said discharge port; and controlling the position of said slide valve so as to load said compressor by the use of gaseous working fluid sourced from one of two locations, one of said locations being downstream of said discharge port and the other of said two locations being upstream of said discharge port and in said working chamber.

32. The method according to claim 31 wherein said selecting step includes the step of automatically selecting to source said gaseous working fluid from the higher pressure one of said two locations without signal or control from exterior of said system.

33. The method according to claim 32 wherein said step of selecting to source said gaseous working fluid from the higher pressure one of said two locations includes the step of selecting to source said gaseous working fluid from a location downstream of said discharge port and external of said compressor.

34. The method according to claim 32 comprising the further step of venting said gaseous working fluid used to load said compressor to a closed compression pocket in said working chamber which is at a pressure less than discharge pressure in order to unload said compressor.

* * * * *

UNITED STATES PATENT AND TRADEMARK OFFICE

CERTIFICATE OF CORRECTION

PATENT NO. : 5,509.273

DATED : April 23, 1996

INVENTOR(S) : Lakowske et al.

It is certified that error appears in the above-indentified patent and that said Letters Patent is hereby corrected as shown below:

Claim 20, Column 13, line 25, before the word "flow" insert -- in --.

Signed and Sealed this

Sixteenth Day of July, 1996

Bruce Lehman

*Attest:*

BRUCE LEHMAN

*Attesting Officer*

*Commissioner of Patents and Trademarks*